US011828152B2

(12) United States Patent
Trotter et al.

(10) Patent No.: US 11,828,152 B2
(45) Date of Patent: Nov. 28, 2023

(54) HYDROFRACTURING APPLICATIONS UTILIZING DRILLING CUTTINGS FOR ENHANCEMENT OF WELLBORE PERMEABILITY

(71) Applicant: Chevron U.S.A. Inc., San Ramon, CA (US)

(72) Inventors: Robert Neil Trotter, Conroe, TX (US); Caleb Kimbrell Carroll, The Woodlands, TX (US); Harold Gordon Riordan, Houston, TX (US); Leonardo F. Chaves Leal, Pittsburg, PA (US); Matthew David Sonnier, Lafayette, LA (US); Jonathon Donald Fisher, Houston, TX (US); Harry Martin Fernau, Houston, TX (US); John Thomas Lattal, Conroe, TX (US); Amos Sunghyun Kim, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 17/231,391

(22) Filed: Apr. 15, 2021

(65) Prior Publication Data

US 2021/0324720 A1 Oct. 21, 2021

Related U.S. Application Data

(60) Provisional application No. 63/011,670, filed on Apr. 17, 2020.

(51) Int. Cl.

| | |
|---|---|
| ***E21B 43/267*** | (2006.01) |
| ***E21B 43/26*** | (2006.01) |
| ***E21B 21/06*** | (2006.01) |

(52) U.S. Cl.

CPC ..... *E21B 43/267* (2013.01); *E21B 21/065* (2013.01); *E21B 43/2607* (2020.05)

(58) Field of Classification Search

CPC ..... C09K 8/805

See application file for complete search history.

(56) References Cited

U.S. PATENT DOCUMENTS

| | | | | |
|---|---|---|---|---|
| 4,595,422 | A * | 6/1986 | Hill | B08B 3/042 134/40 |
| 5,108,226 | A | 4/1992 | Jennings, Jr. | |
| 2006/0048944 | A1 | 3/2006 | van Batenburg et al. | |
| 2008/0135242 | A1 | 6/2008 | Lesko et al. | |
| 2016/0194555 | A1* | 7/2016 | Malachosky | C09K 8/805 507/269 |
| 2018/0202263 | A1* | 7/2018 | Prasad | E21B 43/14 |
| 2018/0244973 | A1* | 8/2018 | Miller | C09K 8/36 |
| 2019/0241789 | A1* | 8/2019 | Agapiou | C09K 8/905 |

* cited by examiner

*Primary Examiner* — William D Hutton, Jr.
*Assistant Examiner* — Avi T Skaist
(74) *Attorney, Agent, or Firm* — King & Spalding LLP

(57) ABSTRACT

The present disclosure provides methods and systems for hydrofracturing processes utilizing native drilling cuttings to enhance wellbore permeability. The native drilling cuttings are obtained during drilling operations and may be used in hydrofracturing applications without further grinding or processing. The native drilling cuttings can be combined into a slurry and injected into a well for the hydrofracturing application. In some cases, the native drilling cuttings are dried before combining them with the slurry.

19 Claims, 11 Drawing Sheets

HYDROFRACTURING APPLICATIONS UTILIZING DRILLING CUTTINGS FOR ENHANCEMENT OF WELLBORE PERMEABILITY

CROSS-REFERENCE TO RELATED APPLICATION

The present application claims priority to U.S. Provisional Patent Application No. 63/011,670 filed Apr. 17, 2020, and titled "Hydrofracturing Applications Utilizing Drilling Cuttings For Enhancement Of Wellbore Permeability," the entire content of which is incorporated herein by reference.

TECHNICAL FIELD

The present application is directed to methods and systems for hydrofracturing processes utilizing native drilling cuttings to enhance wellbore permeability.

BACKGROUND

Hydrofracturing, commonly known as hydraulic fracturing or fracing, is a method of increasing the flow of oil, gas, or other fluids into a wellbore from the surrounding rock formation. Hydrofracturing involves pumping a fracturing liquid into the wellbore under high pressure such that fractures form in the rock formation surrounding the wellbore through which oil and gas can flow into the wellbore and thus, be recovered. However, during recovery, the pressure inside the wellbore, or against the fracture walls, is lower than the pressure applied through the fracturing liquid when forming the fractures. As fractures are formed through high pressure forces rather than through drilling, which involves the removal of mass, fractures are more susceptible to closure due to natural tendency and the forces applied by the surrounding formation.

In order to keep the fractures open to maintain wellbore permeability during recovery, proppant is injected into the fractures to prop the fractures open while allowing fluid to flow through its interstitial space. Proppants are commonly mixed into fracturing fluid and injected into the fractures with the fracturing fluid as the fractures are created. Traditionally, proppants are made from raw materials such as Brady and Ottawa White sands, kaolin, and bauxite. However, due to increasing application of hydrofracturing and thus demand for proppant, the cost of such conventional raw materials is rapidly increasing.

SUMMARY

The present application is generally directed to methods and systems for using native drilling cuttings in a hydrofracturing process in a production well. In one example embodiment, a method of forming a slurry for a hydrofracturing in a production well can comprise obtaining native drilling cuttings that have been separated from a drilling fluid and adding the native drilling cuttings to the slurry for the hydrofracturing process in the production well.

The foregoing method can comprise separating the native drilling cuttings from the drilling fluid. The foregoing method can further comprise removing hydrocarbons and residual fluid from the native drilling cuttings. In the foregoing method, the native drilling cuttings can be added to the slurry without grinding, chemical treatment, or coating of the native drilling cuttings. In the foregoing method, the native drilling cuttings can be dried prior to be added to the slurry.

In the foregoing method, the slurry can further comprise a hydrofracturing fluid and conventional proppants. A ratio of the native drilling cuttings to the conventional proppants can be in a range from about 1:10 to about 1:40 by weight. The native drilling cuttings can be mixed with the hydrofracturing fluid to form the slurry before the conventional proppants are added to the slurry. Alternatively, the native drilling cuttings and the conventional proppants can be mixed before being mixed with the hydrofracturing fluid to form the slurry.

In the foregoing method, the native drilling cuttings can have a base fluid content of 10% or less, or alternatively, a base fluid content in the range of 5% to 10%, or alternatively, a base fluid content in the range of 6% to 9%. In the foregoing method, the native drilling cuttings can have a D50 of not greater than 90 microns. In the foregoing method, the native drilling cuttings can have a volume density maxima that is not greater than 400 microns.

In another example embodiment, a slurry for a hydrofracturing process can comprise a hydrofracturing fluid and native drilling cuttings that have been separated from a drilling fluid. The slurry can further comprise conventional proppants.

In the foregoing slurry, a ratio of the native drilling cuttings to the conventional proppants can be in a range of from about 1:10 to about 1:40 by weight. In the foregoing slurry, the native drilling cuttings can be mixed with the hydrofracturing fluid to form the slurry before the conventional proppants are added to the slurry. Alternatively, the native drilling cuttings and the conventional proppants can be mixed before being mixed with the hydrofracturing fluid to form the slurry.

In the foregoing slurry, the native drilling cuttings can have a base fluid content of 10% or less, or alternatively, a base fluid content in the range of 5% to 10%, or alternatively, a base fluid content in the range of 7% to 8%. In the foregoing slurry, the native drilling cuttings can have a D50 of not greater than 90 microns. In the foregoing slurry, the native drilling cuttings can have a volume density maxima that is not greater than 400 microns.

These and other example embodiments will be described in the following detailed description.

DESCRIPTION OF THE FIGURES

The drawings illustrate only example embodiments of methods and systems for manufacturing hydrofracturing slurries from native drilling cuttings and are therefore not to be considered limiting of its scope, as manufacturing the slurries may admit to other equally effective embodiments. The elements and features shown in the drawings are not necessarily to scale, emphasis instead being placed upon clearly illustrating the principles of the example embodiments. The methods shown in the drawings illustrate certain steps for carrying out the techniques of this disclosure. However, the methods may include more or less steps than explicitly illustrated in the example embodiments. Two or more of the illustrated step may be combined into one step or performed in an alternate order. Moreover, one or more steps in the illustrated method may be replaced by one or more equivalent steps known in the art to be interchangeable with the illustrated step(s).

DESCRIPTION OF EXAMPLE EMBODIMENTS

Example embodiments directed to the use of drilling cuttings for enhancing wellbore permeability will now be described with reference to the accompanying figures.

Figure 1:
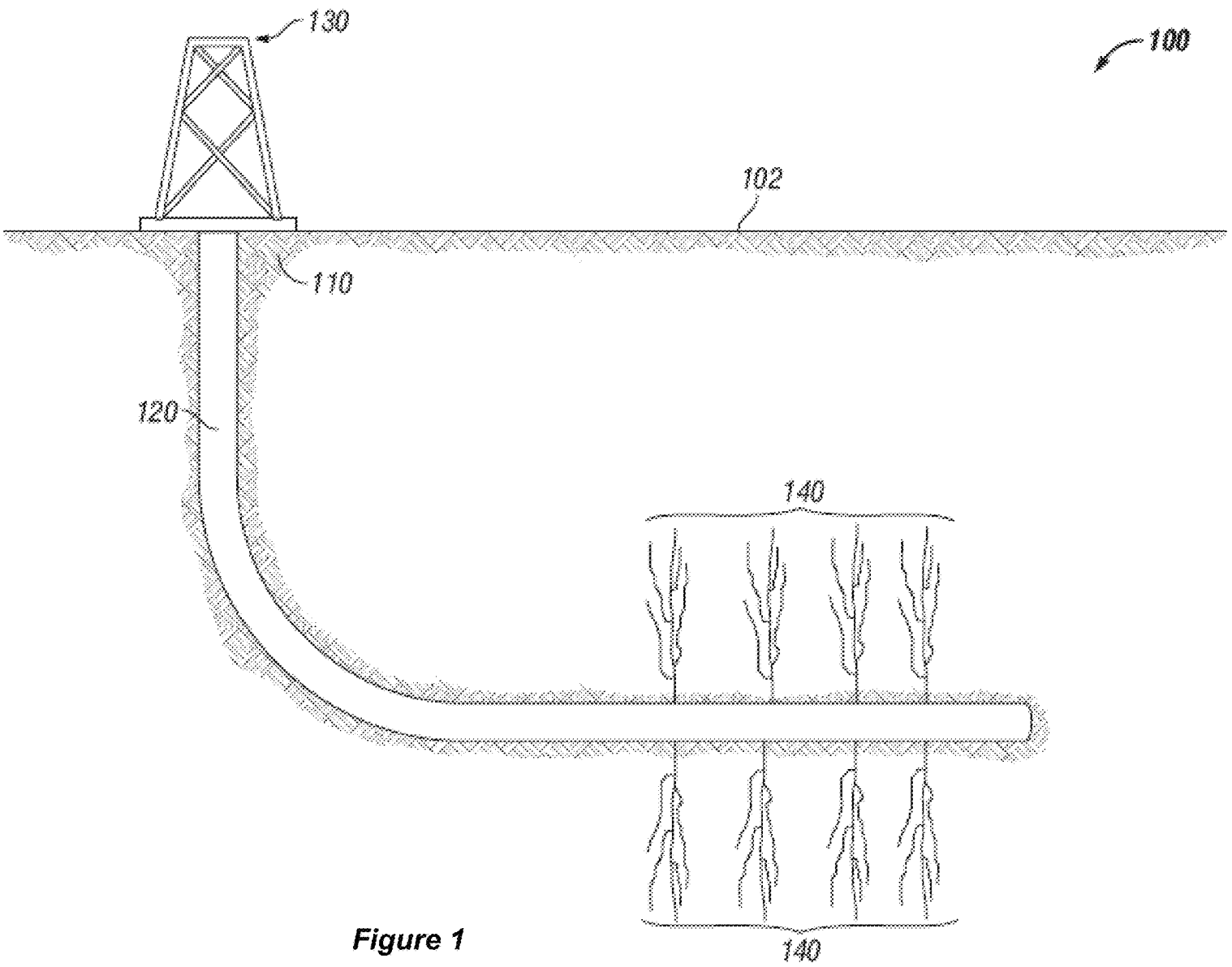
FIG. 1 illustrates a schematic diagram of an oilfield system and wellbore treated with hydrofracturing techniques, in accordance with certain example embodiments.

Drilling cuttings are a typical byproduct of oilfield drilling, or the forming of a wellbore. Referring to FIG. 1, which illustrates an example embodiment of an oilfield system 100 in accordance with an example embodiment, a wellbore 120 is formed in a subterranean formation 110 using field equipment 130 above a surface 102. For on-shore applications, the surface 102 is ground level. For off-shore applications, the surface 102 is the sea floor. The point where the wellbore 120 begins at the surface 102 can be called the entry point. The subterranean formation 110 in which the wellbore 120 is formed includes one or more of a number of formation types, including but not limited to shale, limestone, sandstone, clay, sand, and salt. In certain embodiments, the subterranean formation 110 can also include one or more reservoirs in which one or more resources (e.g., oil, gas, water, steam) can be located. One or more of a number of field operations (e.g., drilling, setting casing, extracting production fluids) can be performed to reach an objective of a user with respect to the subterranean formation 110. During a drilling operation, excavated bits of the subterranean formation 110, referred to as solid drilling cuttings or simply drilling cuttings, are flushed out of the wellbore 120 and brought to the surface 102 by drilling fluid.

The example oilfield system 100 of FIG. 1 further includes fractures 140 formed through a hydrofracturing process. In an example hydrofracturing process, a fluid is injected into the wellbore 120 with high enough pressure to create fractures 140 in the surrounding formation 110. Such a process increases the surface area in the formation 110 from which oil and gas can flow. In certain example embodiments, the fluid includes proppants, which are deposited into the fractures and hold the fractures open, allowing oil and gas to flow from the fractures 140 into the wellbore 120 so that it can be recovered.

Conventionally, the drilling cuttings from a drilling operation are generally discarded as waste, which adds additional cost and other issues to the drilling operation. However, the present disclosure provides methods and techniques for rendering native drilling cuttings for hydrofracturing processes. As used herein, the term "native drilling cuttings" is defined to include solid drilling cuttings that have a mesh size classification similar to that of when the drilling cuttings are separated from the drilling fluid. In some instances, the native drilling cuttings may have a particle size distribution similar to that of when the drilling cuttings are separated from the drilling fluid. Native drilling cuttings may be dried to further remove at least a portion of the drilling fluid content, but they are not further processed (e.g. via grinding, chemical treatment, coating, etc.) to alter the size, shape, or composition of the drilling cuttings. The particle sizes of the native drilling cuttings are no larger than what can be safely moved in conventional disposal methods and/or no larger than obtained outside of standard segregation methods. In some embodiments, native drilling cuttings may be dispersed to break apart compacted cuttings by way of mechanical force.

Figure 2:
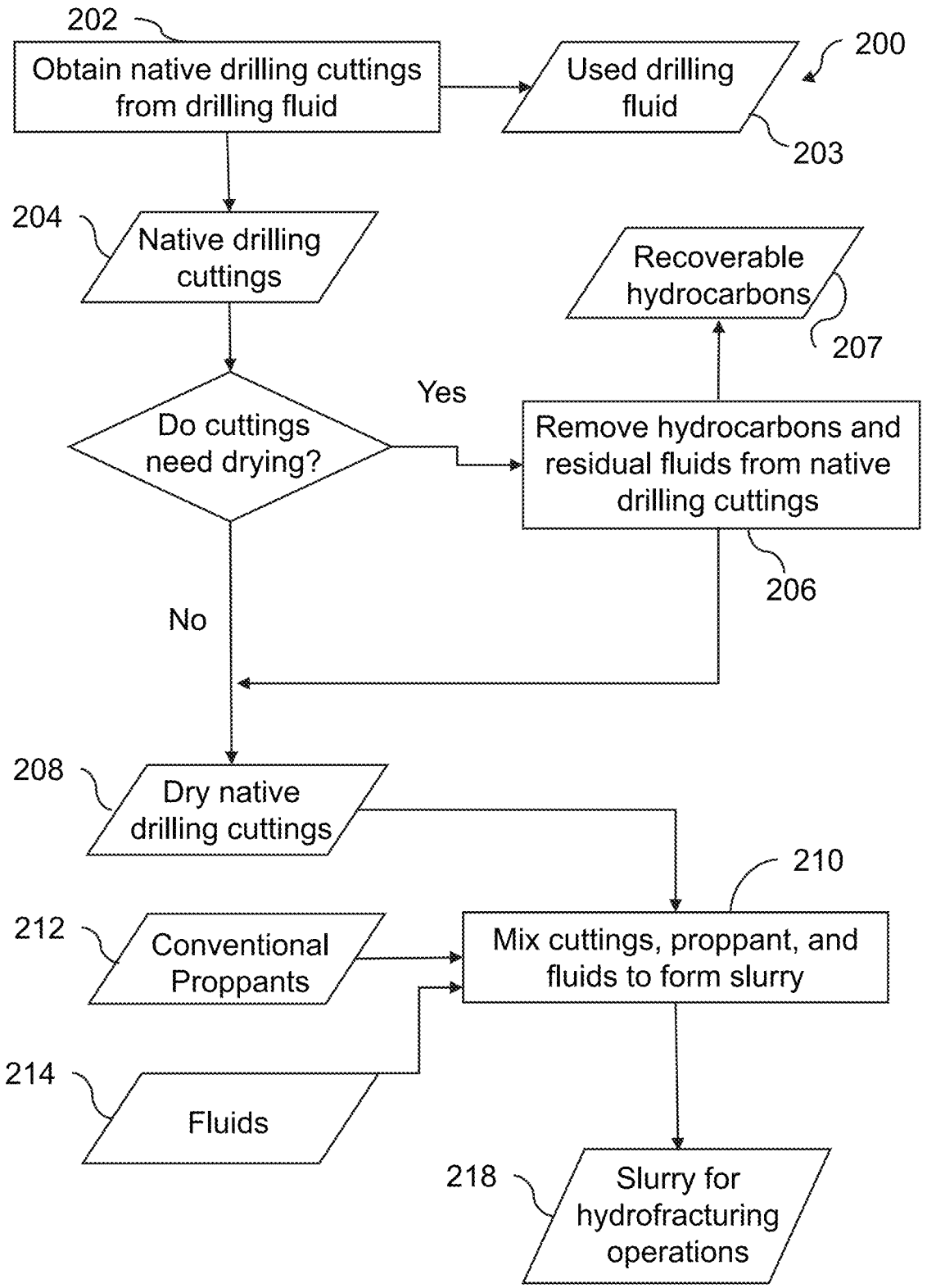
FIG. 2 illustrates a method of manufacturing a slurry for hydrofracturing applications, in accordance with certain example embodiments.

FIG. 2 illustrates a method 200 of utilizing drilling cuttings in hydrofracturing processes, in accordance with example embodiments of the present disclosure. Method 200 and the other example methods described herein can enhance wellbore permeability and are less expensive than solely utilizing proppants made from conventional materials. Referring to FIG. 2, the method 200 includes obtaining native drilling cuttings from drilling fluid (step 202). As briefly described, native drilling cuttings 204 are flushed out of the wellbore 120 (FIG. 1) with drilling fluid 203. Thus, in order to render the drilling cuttings useful in hydrofracturing processes, the native drilling cuttings 204 are separated from the drilling fluid 203. In certain example embodiments, the native drilling cuttings 204 are separated from the drilling fluid 203 through the use of a rig shaker or other separation process. The native drilling cuttings 204, as well as the used drilling fluid 203 are thereby separated and respectively obtained. In certain example embodiments, the used drilling fluid 203 is recycled and reused for another drilling process.

In certain embodiments, after separating the native drilling cuttings from the drilling fluid in step 202 it may be necessary or desired to remove additional hydrocarbons and/or other residual fluids from the native drilling cuttings. If so, the method 200 may further include an additional drying step for removing additional hydrocarbons and/or residual fluids such as mud and water from the native drilling cuttings (step 206), thereby obtaining dry native drilling cuttings 208. In certain example embodiments, a cuttings cleaning unit or a centrifuge is used to dry the cuttings. In certain example embodiments, removal of the remaining hydrocarbon from the native drilling cuttings 204 results in recoverable hydrocarbon 207, or hydrocarbon that is useful for further oil and gas processes or other processes. When the hydrocarbon has been separated from the native drilling cuttings 204, dry native drilling cuttings 208 are obtained.

As an alternative to step 206, if the native drilling cuttings are sufficiently dry after the separating performed in step 202, the additional drying in step 206 can be omitted and the dry native drilling cuttings 208 can be used for hydrofracturing. In certain embodiments, the dry native drilling cuttings 208 can have a small amount of base fluid remaining on the cuttings. The base fluid is typically diesel or a synthetic oil and is a component of the drilling fluid. In certain example embodiments, the dry native drilling cuttings 208 have a base fluid content of 10% (by weight) or less, and preferably, in the range of 5% to 10% (by weight), and more preferably, in the range of 6% to 9% (by weight). Minimizing the amount of base fluid on the dry native drilling cuttings facilitates in the following steps that involve moving and mixing the dry native drilling cuttings with conventional proppants.

In certain exemplary embodiments, the dry native drilling cuttings 208 are then mixed (step 210) with conventional proppants 212 and fluids 214 to form a slurry 218 for use during the completions phase of hydrofracturing applications. In certain embodiments, the ratio of dry native drilling cuttings 208 to conventional proppants 212 is in the range of from about 1:10 to about 1:40 by weight. In other embodiments, the ratio of dry native drilling cuttings 208 to conventional proppants 212 is in the range of from about 1:20 to about 1:40 by weight. In other embodiments, the ratio of dry native drilling cuttings 208 to conventional proppants 212 is in the range of from about 1:10 to about 1:20 by weight. In certain example embodiments the foregoing ratios may be advantageous if the dry native drilling cuttings have a more varied size distribution than the conventional proppants. In certain exemplary embodiments, the fluids 214 are viscosified fluids. In certain embodiments, the fluids 214 are fracturing fluids, produced brine, and the like known to those in the field of hydrofracturing. It should be realized that one having ordinary skill in the art will recognize suitable fluids and other suitable components to include in a slurry for hydrofracturing processes. In certain embodiments, the components for the slurry 218 are mixed together in a recirculating mixer tub, slurrification blender, or batch mixing tank as illustrated and described in connection with the examples of FIGS. 8 and 9 addressed below.

Figure 3:
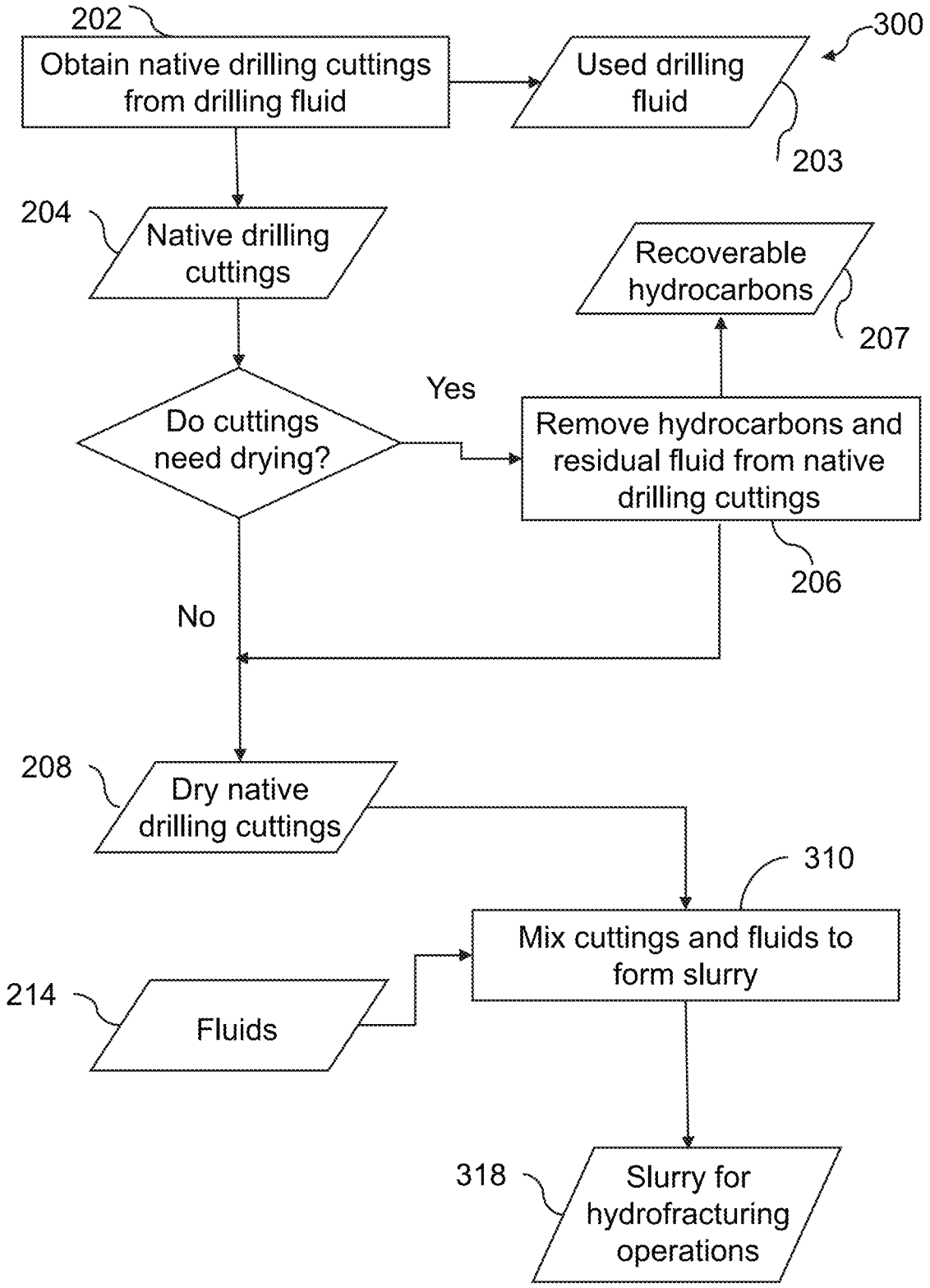
FIG. 3 illustrates a method of manufacturing a slurry for hydrofracturing applications, in accordance with certain example embodiments.

FIG. 3 illustrates a method 300 of utilizing drilling cuttings in hydrofracturing processes, in accordance with another example embodiment of the present disclosure. The method 300 is the same as that described above with regard to method 200, except as specifically stated below. For the sake of brevity, the similarities will not be repeated hereinbelow.

In certain embodiments, the dry native drilling cuttings 208 are used as a replacement for conventional proppants, and the dry native drilling cuttings 208 are mixed (step 310) with fluids 214 to form a slurry 318 for use during the completions phase of hydrofracturing applications. This example embodiment illustrated in FIG. 3 may be advantageous when it is desired to eliminate the use of conventional proppants in the hydrofracturing slurry.

Figure 4A:
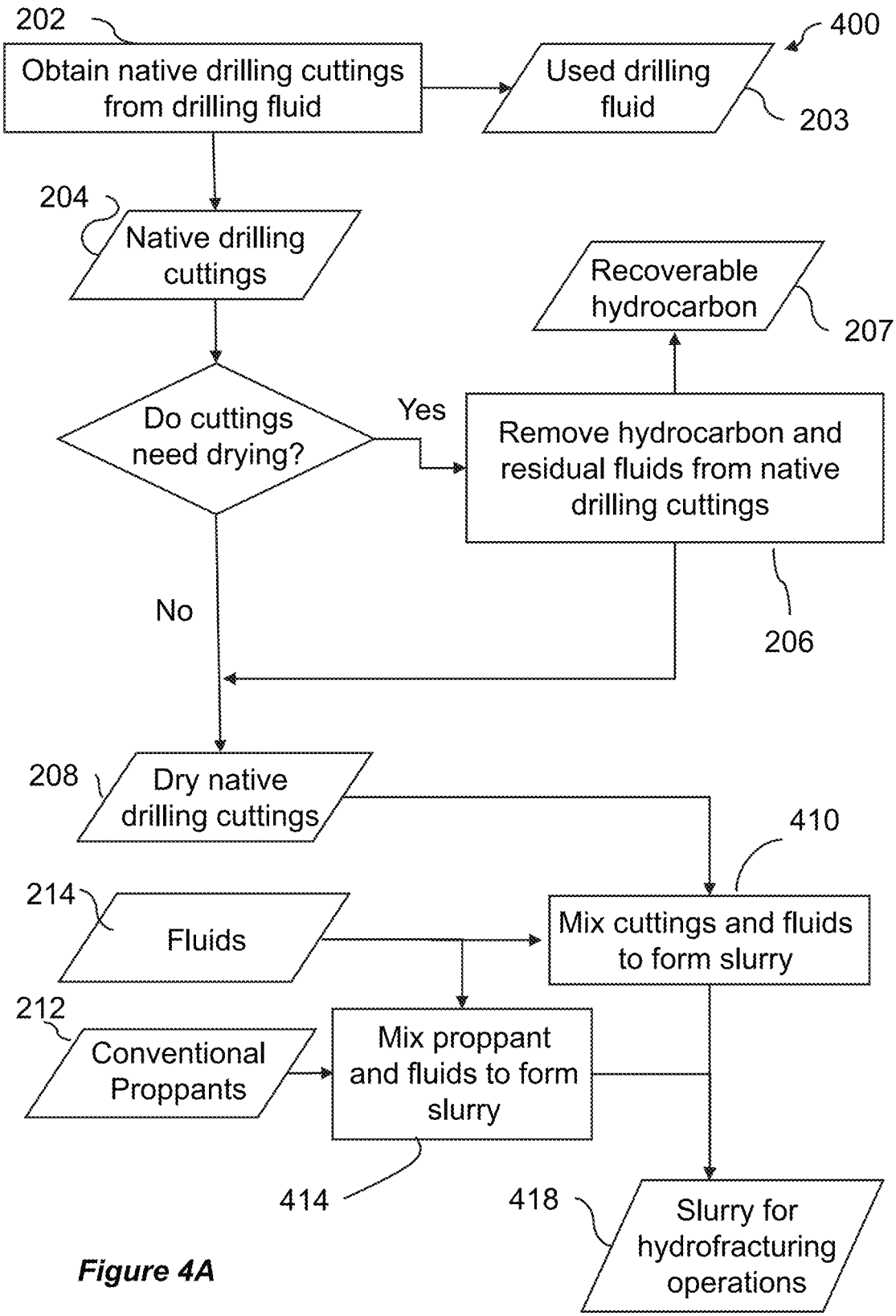
FIG. 4A illustrates a method of manufacturing a slurry for hydrofracturing applications, in accordance with certain example embodiments.

FIG. 4A illustrates a method 400 of utilizing drilling cuttings in hydrofracturing processes, in accordance with another example embodiment of the present disclosure. The method 400 is the same as that described above with regard to method 200, except as specifically stated below. For the sake of brevity, the similarities will not be repeated hereinbelow.

In certain embodiments, the dry native drilling cuttings 208 are mixed (step 410) with fluids 214 to form a first slurry, the conventional proppants 212 are mixed (step 414) with fluids 214 to form a second slurry, and the first slurry and second slurry are combined to form a slurry 418 for use during the completions phase of hydrofracturing applications.

Figure 4B:
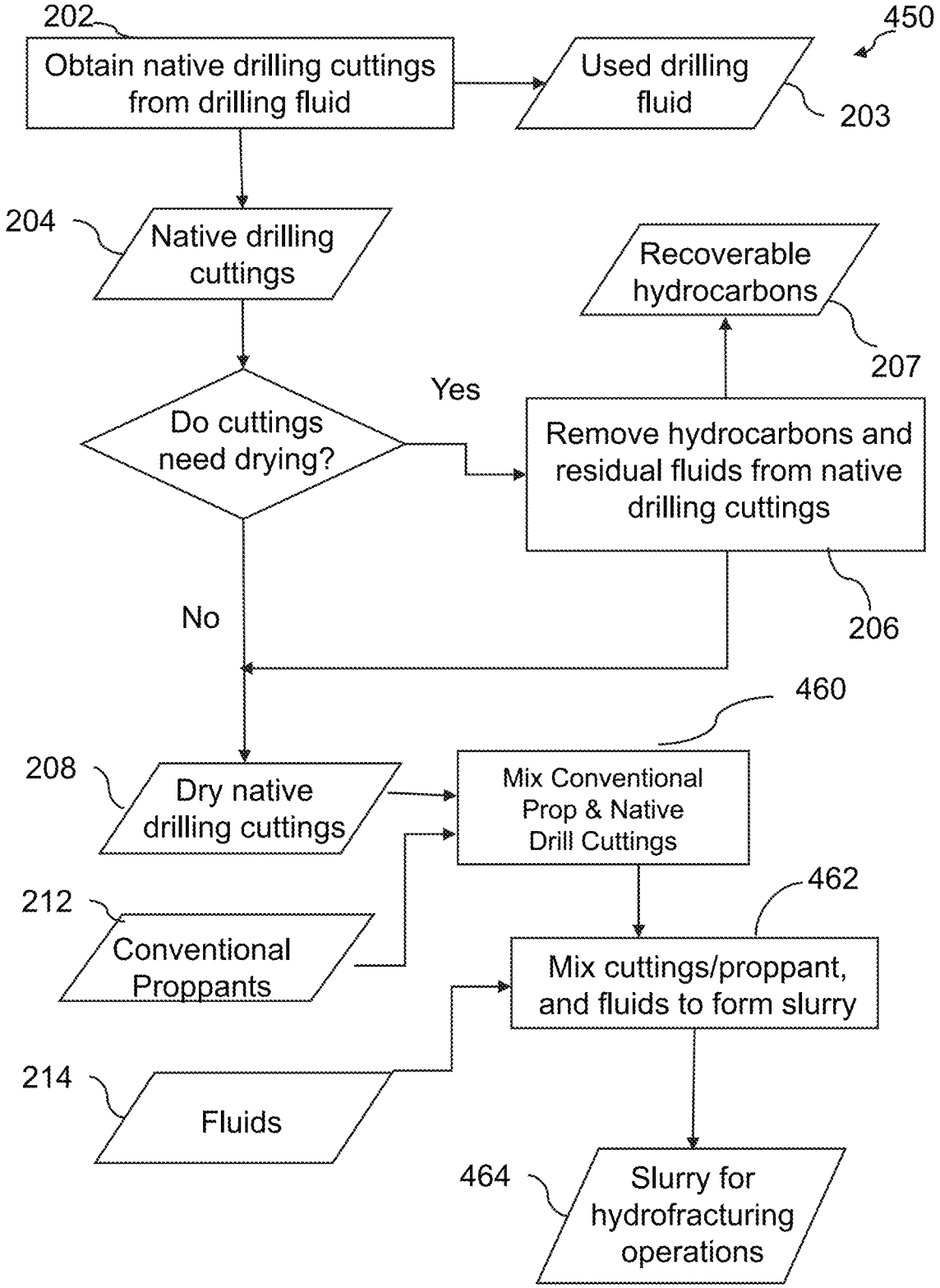
FIG. 4B illustrates a method of manufacturing a slurry for hydrofracturing applications, in accordance with certain example embodiments.
Figure 5A:
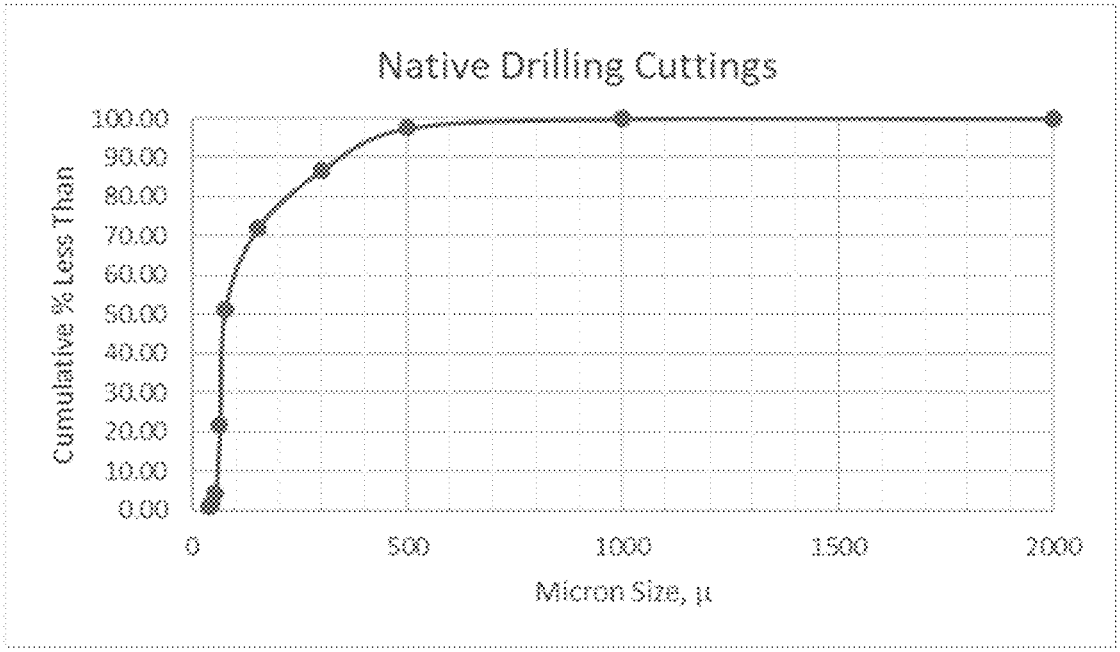
FIG. 5A illustrates a particle size analysis of native drilling cuttings, in accordance with certain example embodiments.
Figure 5B:
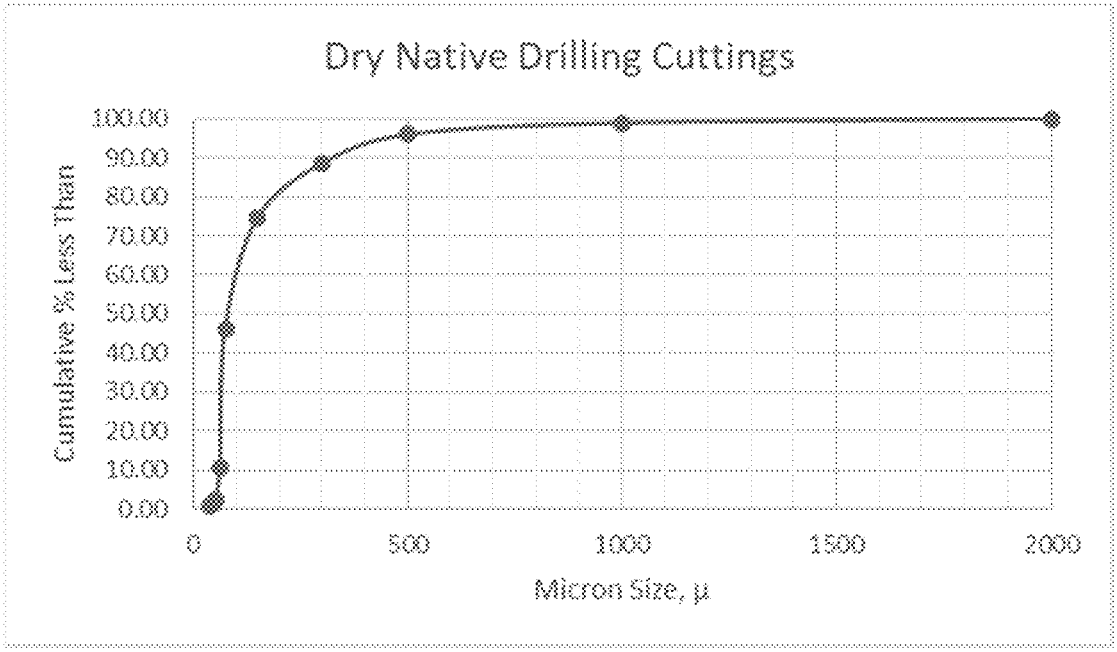
FIG. 5B illustrates a particle size analysis after drying the native drilling cuttings of FIG. 5A, in accordance with certain example embodiments.
Figure 5C:
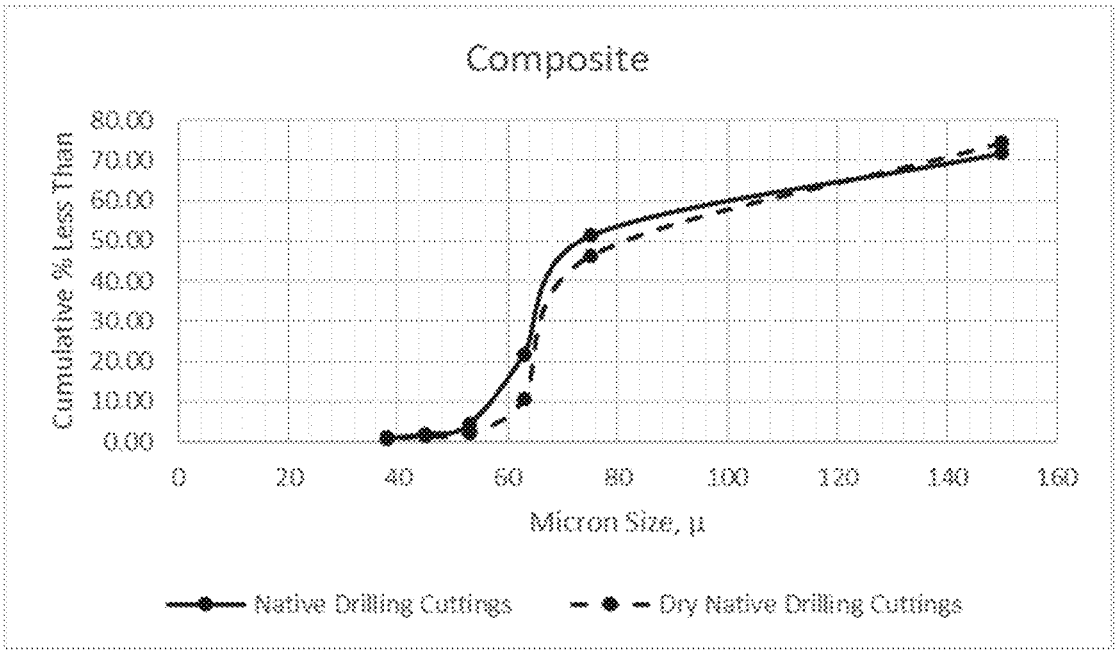
FIG. 5C illustrates a close up view of the lower range of the particle size analysis of the native drilling cuttings of FIGS. 5A-5B, in accordance with certain example embodiments.
Figure 5D:
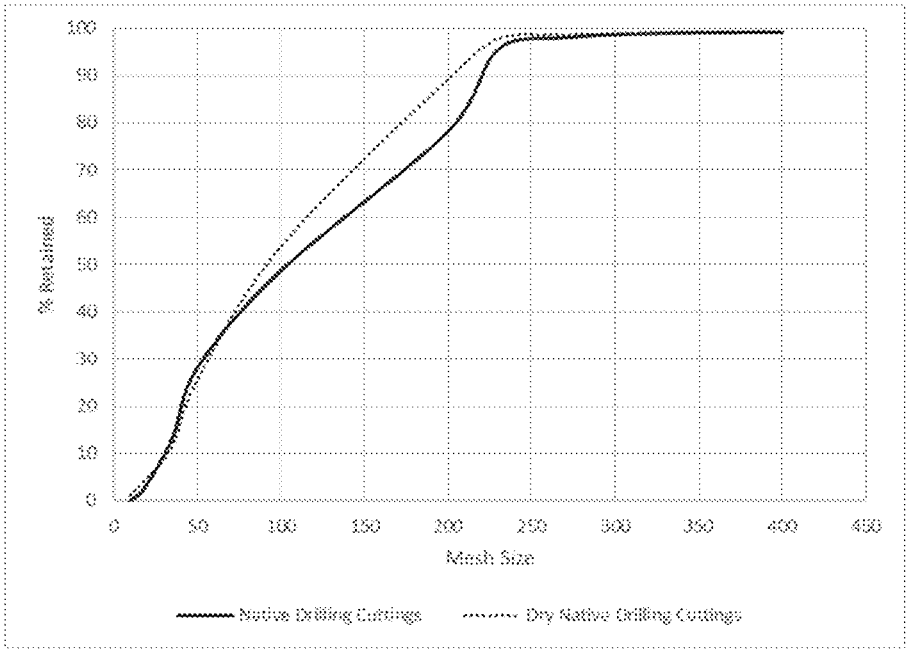
FIG. 5D is a graphical illustration classifying the mesh size of the native drilling cuttings of FIG. 5A and the dry native drilling cuttings of FIG. 5B, in accordance with certain example embodiments.
Figure 6A:
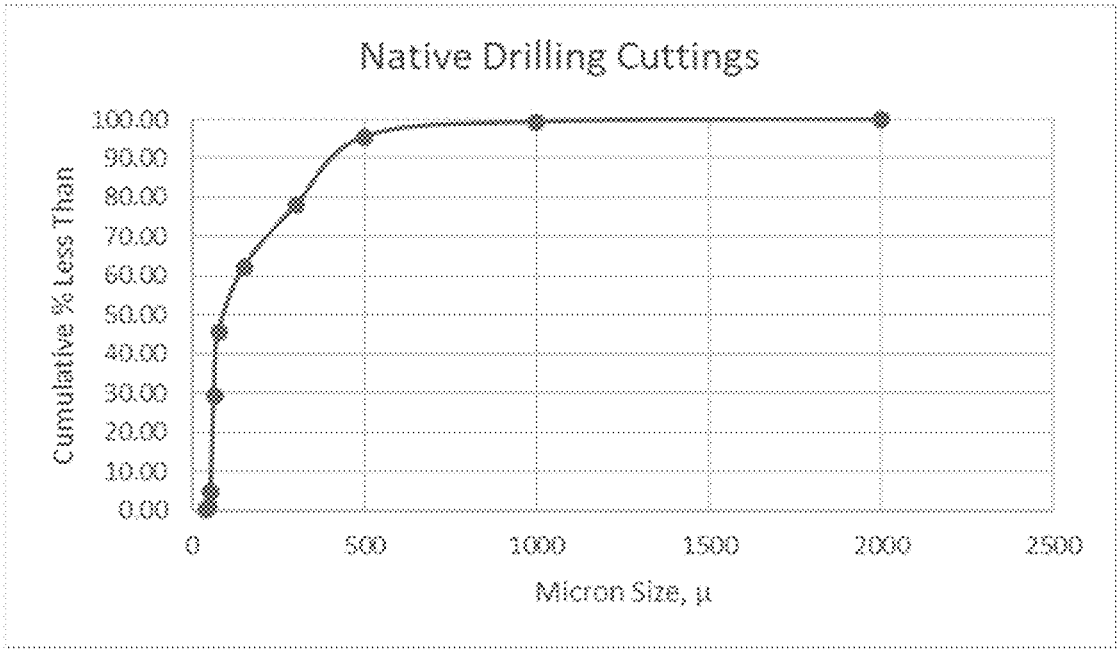
FIG. 6A illustrates a particle size analysis of native drilling cuttings, in accordance with certain example embodiments.
Figure 6B:
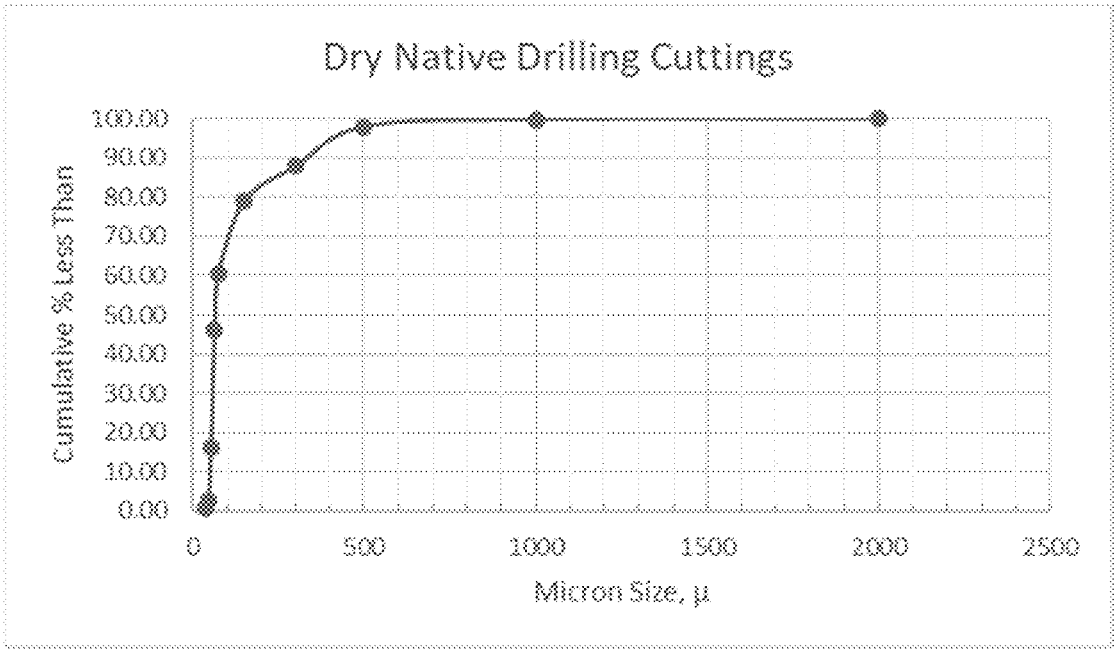
FIG. 6B illustrates a particle size analysis after drying the native drilling cuttings of FIG. 6A, in accordance with certain example embodiments.
Figure 6C:
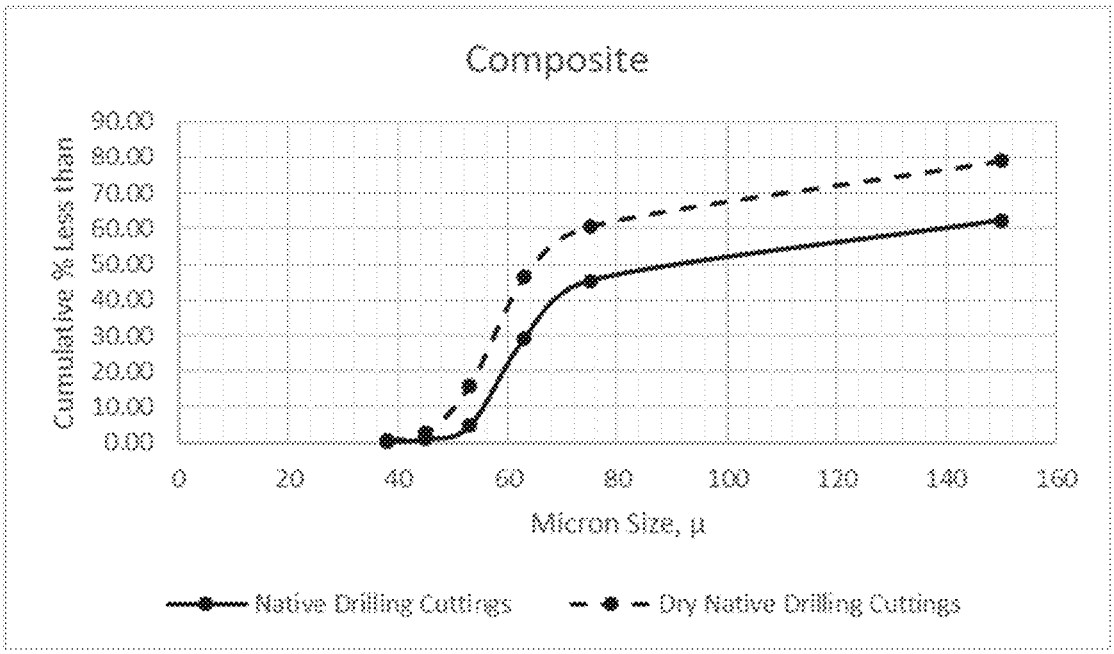
FIG. 6C illustrates a close up view of the lower range of the particle size analysis of the native drilling cuttings of FIGS. 6A-6B, in accordance with certain example embodiments.
Figure 6D:
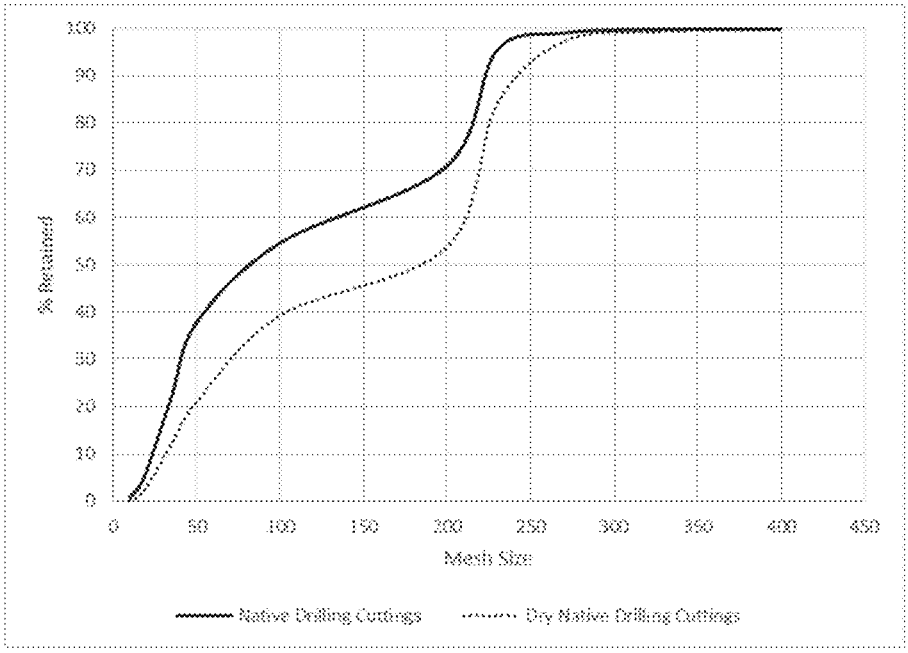
FIG. 6D is a graphical illustration classifying the mesh size of the native drilling cuttings of FIG. 6A and the dry native drilling cuttings of FIG. 6B, in accordance with certain example embodiments.

FIG. 4B illustrates a method 450 of utilizing drilling cuttings in hydrofracturing processes, in accordance with another example embodiment of the present disclosure. The method 450 is the same as that described above with regard to method 200, except as specifically stated below. For the sake of brevity, the similarities will not be repeated hereinbelow.

In certain embodiments, the dry native drilling cuttings 208 are first mixed with conventional proppants 212 (step 460). Example method 450 of FIG. 4B may be advantageous because it may be easier to transport the dry native drilling cuttings 208 and the conventional proppants 212 before they are mixed with a fluid. For example, the dry native drilling cuttings 208 can be dropped from a storage box onto a conveyor belt. The conventional proppants 212 can then be added on top of the dry native drilling cuttings 208. As mentioned previously, minimizing the amount base fluid on the dry native drilling cuttings 208 (e.g. 10% or less) facilitates the handling and mixing of the dry native drilling cuttings. Next, the mixture of dry native drilling cuttings 208 and conventional proppants 212 are mixed with fluids (step 462) to produce a slurry (464) used for hydrofracturing operations.

Figure 7A:
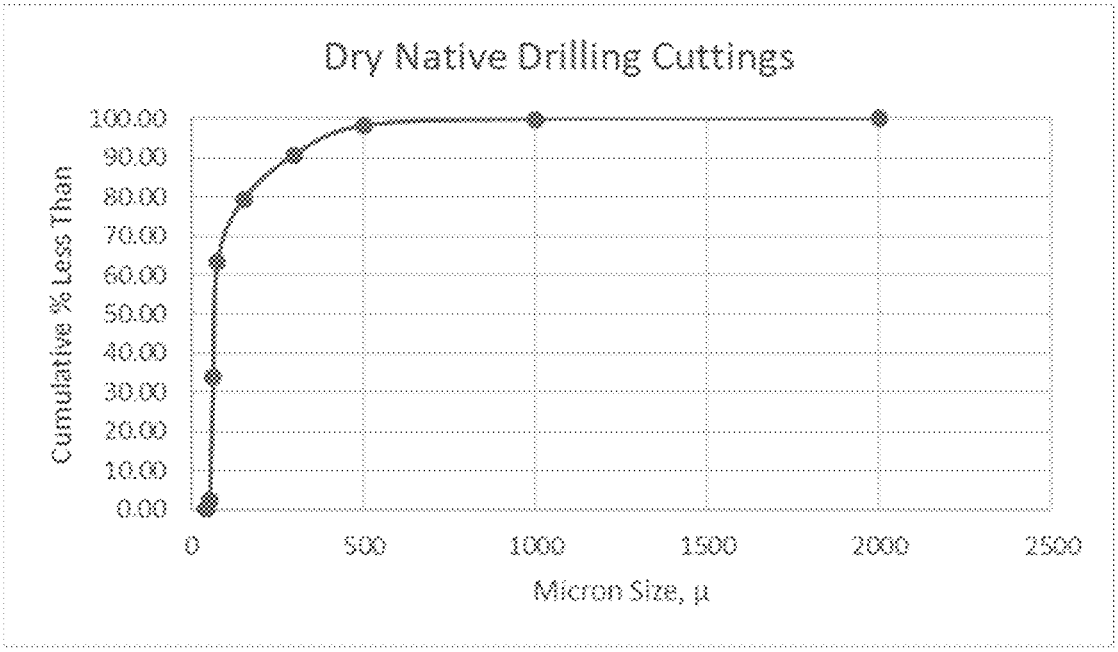
FIG. 7A illustrates a particle size analysis of dry native drilling cuttings, in accordance with certain example embodiments.
Figure 7B:
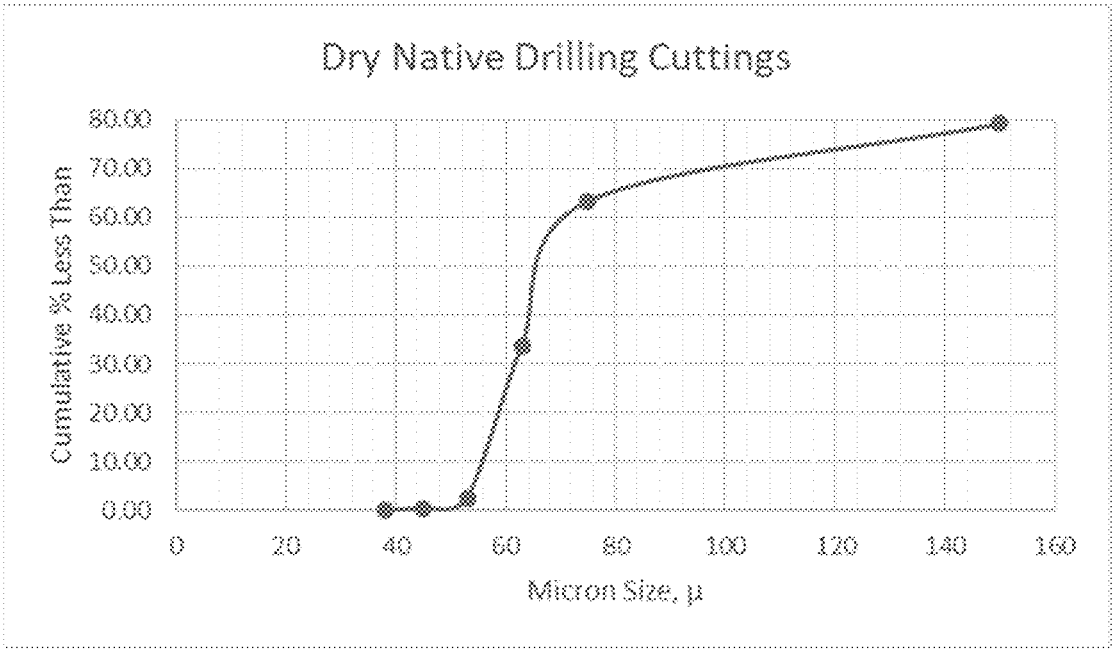
FIG. 7B illustrates a close up view of the lower range of the particle size analysis of the native drilling cuttings of FIG. 7A, in accordance with certain example embodiments.

Generally, the native drilling cuttings that are present in the slurries of the present invention are placed within the fractures 140 (FIG. 1) formed during hydrofracturing processes, and support the fracture walls to keep the fracture 140 open. In certain embodiments, the native drilling cuttings for use in the present invention are 30/400 (US Sieve Size) particles, or 30/400 particles if dried, as shown in FIGS. 5A-5D. In other words, 90% of the solids will go through the first mesh sieve (30), but will not go through the second (400). In certain other embodiments, the native drilling cuttings are 20/325 mesh, or 30/325 mesh if dried, as shown in FIGS. 6A-6D. In certain other embodiments, the dry native drilling cuttings are 40/400 particles, as shown in FIGS. 7A-7B. By comparison, conventional proppants used in hydrofracturing processes are 20/40 mesh or 40/70 mesh. In addition, the dry native drilling cuttings of the present invention have a D50 (median diameter) of not greater than 90 microns, and a volume density maxima that is not greater than 400 microns. In certain exemplary embodiments, the dry native drilling cuttings of the present invention have a D50 of not greater than 75 microns.

Accordingly, due to the size range/mesh classification of the native drilling cuttings, smaller fractures created during the fracturing stage that cannot be propped open through the use of conventional proppant blends are able to be propped open. The propping open of these smaller fractures expose additional reservoir improving permeability and production.

Figure 8:
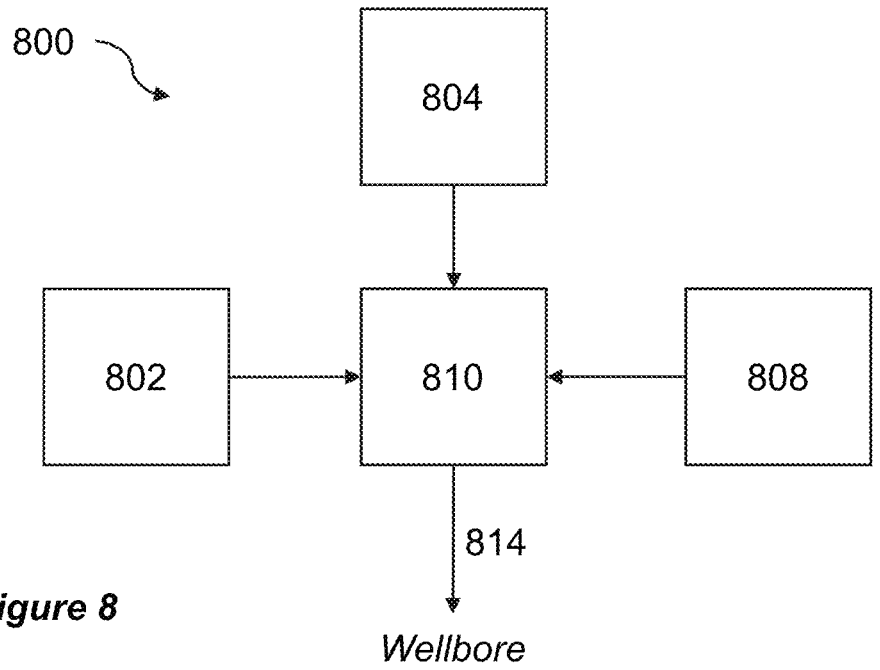
FIG. 8 illustrates an example of a hydrofracturing system, in accordance with certain example embodiments.

FIG. 8 illustrates a hydrofracturing system 800 of the present invention, according to an exemplary embodiment. In certain embodiments, the system 800 includes a fluid producing apparatus 802, a conventional proppant source 804, a native drilling cuttings source 808, and a mixer system 810. Generally, the system 800 is located at the surface where wellbore 120 (FIG. 1) is located. One having ordinary skill in the art will recognize that in certain instances, viscosified fluid produced from the fluid producing apparatus may comprise water, a hydrocarbon fluid, a polymer gel, foam, air, wet gases, other additives (e.g. gelling agents, weighting agents), and/or other fluids. The mixer system 810 receives and combines the viscosified fluid, conventional proppants, and native drilling cuttings. The resulting slurry 814 may be pumped down the wellbore 120 for hydrofracturing applications.

Figure 9:
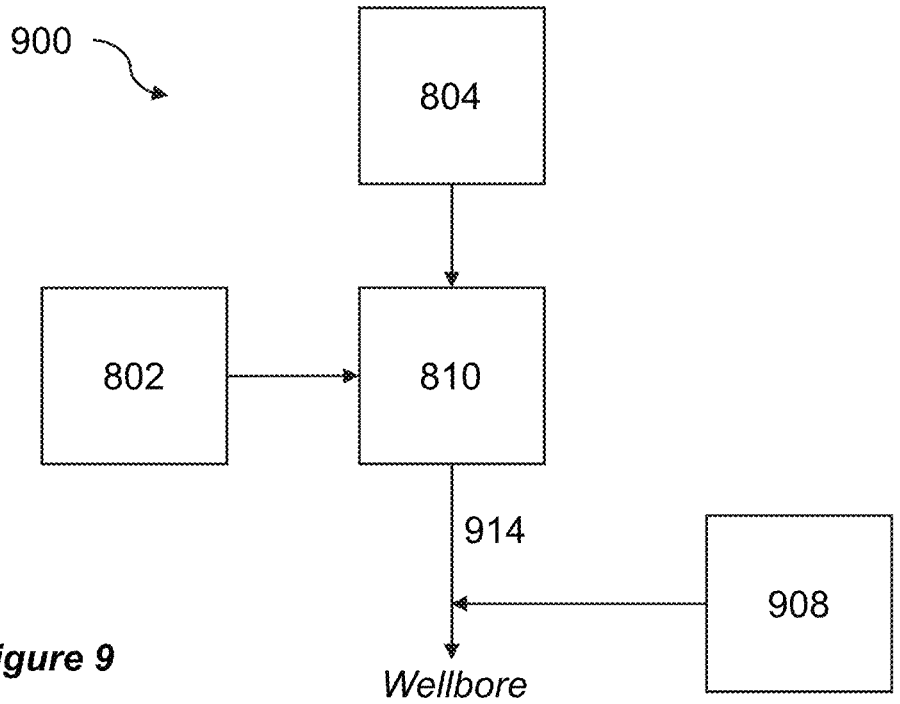
FIG. 9 illustrates an example of a hydrofracturing system, in accordance with certain example embodiments.

FIG. 9 illustrates a hydrofracturing system 900 of the present invention, according to another exemplary embodiment. The system 900 is the same as that described above with regard to system 800, except as specifically stated below. For the sake of brevity, the similarities will not be repeated hereinbelow.

In certain embodiments, the system 900 includes a fluid producing apparatus 802, a conventional proppant source 804, a native drilling cuttings source 908, and a mixer system 810. The mixer system 810 receives and combines the viscosified fluid and conventional proppants. The resulting slurry 914 may be pumped down the wellbore 120 for hydrofracturing applications. The native drilling cuttings may be added to the slurry 914 at a point away from the mixer system 810, and also be pumped down the wellbore 120. For instance, the slurry 914 may be pumped at 90 barrels per minute (bpm) and the native drilling cuttings may be pumped at 7 bpm, for a total of 97 bpm being delivered to the wellbore 120. In the example system 900 of FIG. 9, the native drilling cuttings may be mixed with a fluid to form a slurry to facilitate transport of the native drilling cuttings from the source 908 to the point of mixing with the slurry 914.

It should be understood that the systems illustrated in FIGS. 8 and 9 can be further modified within the scope of the present disclosure. For example, as described in connection with FIG. 3 above, in certain embodiments the slurry may contain native drilling cuttings, but no conventional proppant. In such an embodiment, systems 800 and 900 would be modified to eliminate the conventional proppant source 804.

The present disclosure provides methods and techniques of using native drilling cuttings to enhance wellbore permeability during hydrofracturing processes. Drilling cuttings are otherwise typically discarded as a drilling byproduct or waste. As drilling cuttings are a common byproduct, and therefore are abundant and generally readily available, large amounts may be utilized in a cost effective manner. The techniques disclosed herein provide both a cost effective and an environmentally beneficially way of utilizing drilling cuttings. The environmental benefits include reducing the volume of drilling cuttings that typically would be processed and removed from the well site as well as reducing need for conventional proppant which reduces the consumption of the natural resources used to create conventional proppant. Additionally, the native drilling cuttings produced can be used for other applications and processes.

With respect to the example methods described herein, it should be understood that in alternate embodiments, certain steps of the methods may be combined, may be performed in a different order, may be performed in parallel, or may be omitted. Moreover, in alternate embodiments additional steps may be added to the example methods described herein. Accordingly, the example methods provided herein should be viewed as illustrative and not limiting of the disclosure.

With respect to the apparatus illustrated and described herein, it should be understood that one or more of the components may be omitted, added, repeated, and/or substituted. Accordingly, embodiments described herein or shown in a particular figure should not be considered limited to the specific arrangements of components shown in such figure. Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure.

The terms "a," "an," and "the" are intended to include plural alternatives, e.g., at least one. The terms "including", "with", and "having", as used herein, are defined as comprising (i.e., open language), unless specified otherwise.

Various numerical ranges are disclosed herein. When Applicant discloses or claims a range of any type, Applicant's intent is to disclose or claim individually each possible number that such a range could reasonably encompass, including end points of the range as well as any sub-ranges and combinations of sub-ranges encompassed therein, unless otherwise specified. Numerical end points of ranges disclosed herein are approximate, unless excluded by proviso.

Values, ranges, or features may be expressed herein as "about", from "about" one particular value, and/or to "about" another particular value. When such values, or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed therein, and that each value is also herein disclosed as "about" that particular value in addition to the value itself. In another aspect, use of the term "about" means ±20% of the stated value, ±15% of the stated value, ±10% of the stated value, ±5% of the stated value, ±3% of the stated value, or ±1% of the stated value.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method of forming a slurry for a hydrofracturing process in a well, the method comprising:

obtaining native drilling cuttings that have been separated from a drilling fluid; and adding the native drilling cuttings to the slurry for the hydrofracturing process in the well, wherein the native drilling cuttings are added to the slurry without altering a size of the native drilling cuttings, wherein the slurry comprises a hydrofracturing fluid and a proppant, the proppant chosen from the group of: sand, kaolin, and bauxite, wherein the native drilling cuttings have a median diameter of not greater than 90 microns and a size distribution with greater variability than a size distribution of the proppant, and wherein a ratio of the native drilling cuttings to the proppant is in a range of from about 1:10 to about 1:40 by weight to accommodate the greater variability of the size distribution of the native drilling cuttings relative to the size distribution of the proppant.

2. The method of claim 1, further comprising:

removing hydrocarbons and residual fluids from the native drilling cuttings.

3. The method of claim 1, wherein the native drilling cuttings are added to the slurry without grinding, chemical treatment, or coating of the native drilling cuttings.

4. The method of claim 1, wherein the native drilling cuttings are dried prior to being added to the slurry.

5. The method of claim 1, wherein the native drilling cuttings are mixed with the hydrofracturing fluid to form the slurry before the proppant is added to the slurry.

6. The method of claim 1, wherein the native drilling cuttings and the proppant are mixed before being mixed with the hydrofracturing fluid to form the slurry.

7. The method of claim 1, wherein the native drilling cuttings have a base fluid content of 10% or less.

8. The method of claim 1, wherein the native drilling cuttings have a base fluid content in the range of 5% to 10%.

9. The method of claim 1, wherein the native drilling cuttings have a base fluid content in the range of 6% to 9%.

10. The method of claim 1, wherein the native drilling cuttings have a size ranging between 20/325 mesh and 40/400 mesh.

11. The method of claim 1, wherein the well is one of:

a production well;

an injector well; and an exploratory well.

12. The method of claim 1, wherein the slurry is injected into the well in the hydrofracturing process.

13. A slurry for a hydrofracturing process, the slurry comprising:

a hydrofracturing fluid; and native drilling cuttings that have been separated from a drilling fluid, wherein the native drilling cuttings are added to the slurry without altering a size of the native drilling cuttings, wherein the slurry comprises a hydrofracturing fluid and a proppant, the proppant chosen from the group of: sand, kaolin, and bauxite, wherein the native drilling cuttings have a median diameter of not greater than 90 microns and a size distribution with greater variability than a size distribution of the proppant, and wherein a ratio of the native drilling cuttings to the proppant is in a range of from about 1:10 to about 1:40 by weight to accommodate the greater variability of the size distribution of the native drilling cuttings relative to the size distribution of the proppant.

14. The slurry of claim 13, wherein the native drilling cuttings are mixed with the hydrofracturing fluid to form the slurry before the proppant is added to the slurry.

15. The slurry of claim 13, wherein the native drilling cuttings and the proppant are mixed before being mixed with the hydrofracturing fluid to form the slurry.

16. The slurry of claim 13, wherein a content of a base fluid remaining on the native drilling cuttings is 10% or less.

17. The slurry of claim 13, wherein a content of a base fluid remaining on the native drilling cuttings is in a range of 5% to 10%.

18. The slurry of claim 13, wherein a content of a base fluid remaining on the native drilling cuttings is in a range of 6% to 9%.

19. The slurry of claim 13, wherein the native drilling cuttings have a size ranging between 20/325 mesh and 40/400 mesh.

* * * * *